United States Patent [19]

Malek et al.

[11] 3,983,336

[45] Sept. 28, 1976

[54] DIRECTIONAL SELF CONTAINING EAR MOUNTED HEARING AID

[76] Inventors: Hooshang Malek, 3028 Essex Road, Baltimore, Md. 21207; Alvin F. Polan, 444 E. Belvedere Ave., Baltimore, Md. 21212

[22] Filed: Oct. 15, 1974

[21] Appl. No.: 514,931

[52] U.S. Cl. ..... 179/107 FD; 179/107 E

[51] Int. Cl.[2] ..... H04R 1/32; H04R 25/00; H04R 25/02

[58] Field of Search ..... 179/107 E, 107 FD, 107 R, 179/107 H, 107 S

[56] References Cited

UNITED STATES PATENTS

| | | | |
|---|---|---|---|
| 2,521,414 | 9/1950 | Schier | 179/107 E |
| 3,076,061 | 1/1963 | Thompson | 179/107 S |
| 3,197,576 | 7/1965 | Martin | 179/107 E |
| 3,491,214 | 1/1970 | Rosemond et al. | 179/107 FD |

FOREIGN PATENTS OR APPLICATIONS

| | | | |
|---|---|---|---|
| 787,035 | 11/1957 | United Kingdom | 179/107 R |

*Primary Examiner*—Kathleen H. Claffy
*Assistant Examiner*—George G. Stellar
*Attorney, Agent, or Firm*—George H. Mitchell, Jr.

[57] ABSTRACT

Improved quality of sound perception and discrimination in a self-powered, ear-mounted hearing aid is accomplished by pivotally mounting the sound inlet passage for 360° rotation in a plane parallel to the ears of the wearer.

13 Claims, 9 Drawing Figures

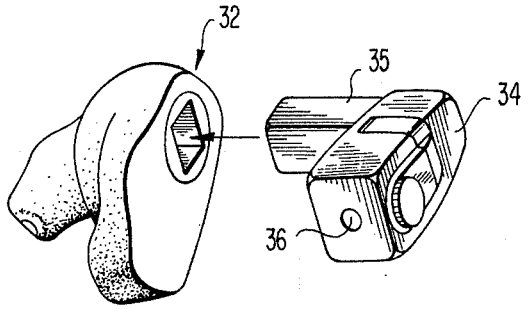
FIG. 4
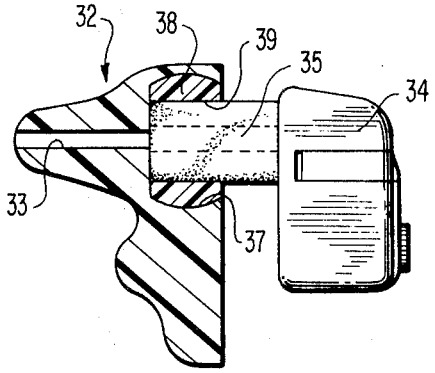
FIG. 5
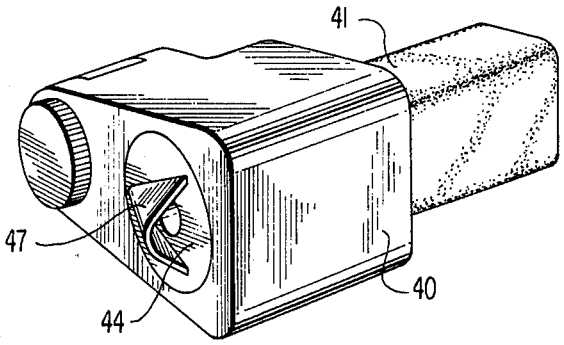
FIG. 6
FIG. 7
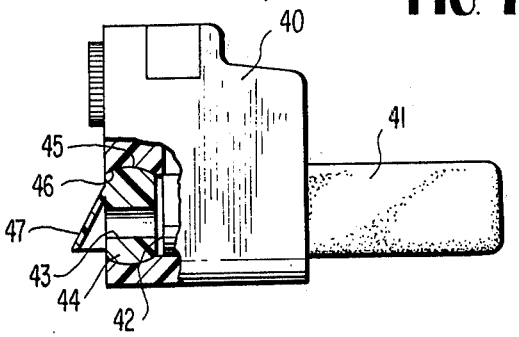

DIRECTIONAL SELF CONTAINING EAR MOUNTED HEARING AID

The present invention relates to hearing aids and more particularly to miniaturized hearing aids of the type wherein all of the electrical and mechanical elements, including a replaceable battery, are contained within a housing small enough to be positioned entirely within the largest, and deepest, concavity of the external ear, known as the concha, the housing being provided with a projection with a channel to be inserted into the ear canal for supporting the housing in place and transmitting sound into the inner ear.

It is well known that electrical hearing aids which pick up sounds by means of a single electro-acoustical transducer such as a single microphone cannot reproduce the natural hearing process as represented by the two, spatially separated, human ears.

A single microphone is not merely incapable of providing a binaural signal, it also is incapable of making the subtle distinctions between different frequencies and harmonics of frequencies of which the human ear is capable. Thus, the wearer of a hearing aid has difficulty in distinguishing a single voice when in the midst of a group of people or when a conversation is conducted in the presence of "background" noise of the type caused by city vehicular traffic or a large social gathering. This is due to the fact that electro-acoustical systems amplify each sound of a given frequency by an equal amount. The human ear however has the capability of focusing attention on sounds not only of a given frequency but accompanied by a distinctive pattern of harmonics which enables a person with normal hearing to instinctively suppress or diminish unwanted sounds in order to concentrate on a specific desired source of sound.

While directional microphones capable of picking up sounds originating at highly selective locations are known, these devices require bulky equipment such as parabolic reflectors or long tubes resembling shotguns which make them completely impractical as hearing aids to be worn on the body.

In fact the tendency towards miniaturization of hearing aids has reached the stage that complete hearing devices can be concealed within the frames of spectacles so as to make them practically unnoticeable. In the case of persons who do not wear glasses, hearing aids are also available which are contained in housings which are contained within the exterior ear supported on flexible plugs fitted into the ear canal.

In the case of miniaturized hearing aids the microphone is placed behind a small passage in the housing, or spectacle frame, which faces forward. In such cases any directional effect is minimal and confined to an emphasis on sounds originating from any location in front of the wearer as opposed to those from the rear. There are even miniaturized hearing aids wherein the microphone is placed close to the head and in back of the ear, whereby sounds from the front are received more or less by reflection and reverberation.

The applicant, as a result of experience in the fitting of hearing aids to the requirements of wearers, that in the case of ear-contained hearing aids, a change in the direction in which the sound inlet passage faces can alter the user's perception of the sounds received and the ability to discriminate between wanted and unwanted sounds, especially in the case of conversation.

However, prior to the development of the present invention this phenomenon could not be properly exploited because with the known ear-contained hearing aids the direction in which the sound inlet passage faced could not be adjusted to any appreciable extent. Since, it had been previously considered that it was most desirable for the microphone, or the inlet passage to the microphone should face forwardly, the conventional ear-contained hearing aid housing comprised a generally horizontally elongated rectangular structure, supported at one end by the projecting hollow member which is inserted into the ear canal. Due to the fact that the tapering wall of the exterior ear surrounding the rear half of the ear canal is very close to the canal this meant that, while the housing could be placed close to the ear, it had to be horizontal and project in a forward direction where the taper of the wall of the ear was nearly flat. And for this reason the sound inlet was placed in the forward end wall.

However, experiment has shown that the forward direction for the sound inlet passage does not always produce optimum results. In some cases, it has been found that an individual is better able to identify and perceive desired sounds, or conversations, when the sound inlet passage is directed in other directions such as upwardly, downwardly, or even when facing to the rear. It is now known why this is so but it may result from an interaction between the tissue of the concha of the ear and reflection of the sound into the sound passage.

Thus, while the design of prior art hearing aids has been directed towards shaping the housing to fit as closely and inconspicuously as possible, in one position, in the ear, one of the objects of the present invention is to provide an arrangement which will enable the user to adjust the direction in which the sound inlet passage is directed.

In one form of the invention, it is contemplated that the housing be mounted for rotation about its axis of symmetry, whereby the angular position of the sound inlet passage may be adjusted to that which produces the best results for the individual wearer.

Another modification involves the provision of an ear mold, designed for an individual ear, but having a swivel socket to receive the supporting projection of a conventional hearing aid, so that its sound inlet passage can be adjusted to face in a plurality of angular directions.

In another form, the housing itself may remain fixed, but the sound inlet passage itself may be mounted for swivelling movement, at least partially, in all three planes.

Other objects and advantages will be apparent to those skilled in the art after reading the following specification in connection with the annexed drawings, in which:

FIG. 4 is a perspective exploded view of a modified form of hearing aid supported by an earplug;

FIG. 5 is a cross-section of the modification of the hearing aid of FIG. 4 shown inserted into the earplug;

FIG. 6 is a perspective view of a further modification of the invention;

FIG. 7 is a fragmentary cross-section of the sound inlet passage of the hearing aid of FIG. 6.

Turning now to the drawings in detail, a preferred form of hearing aid, indicated generally by numeral 10, comprises a housing 11, provided with an elongated supporting member 12 which projects outwardly from approximately the center of mass of the housing, and may be composed of relatively soft material so as to be comfortably received within the ear canal of the wearer to support the housing completely within the concha 13 of the ear.

Figure 1:
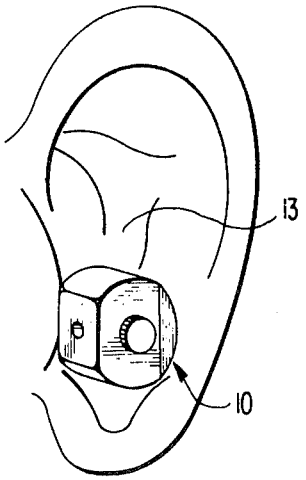
FIG. 1 is a perspective view of a preferred form of hearing aid constructed in accordance with this invention shown in the position in the ear of a wearer.
Figure 2:
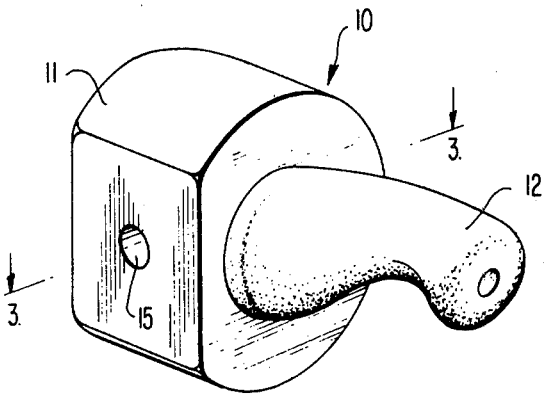
FIG. 2 is also a perspective view, on an enlarged scale, of the hearing aid of FIG. 1 above, but viewed from the opposite side.
Figure 3:
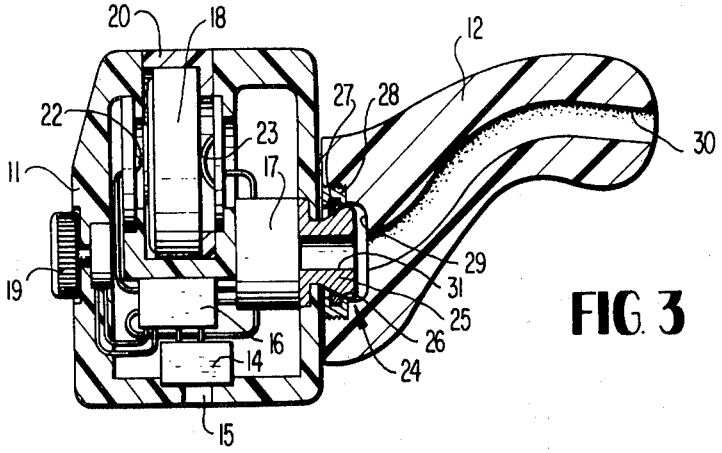
FIG. 3 is a cross-section taken on the line 3—3 of FIG. 2.

All of the electrical and mechanical components for detecting, amplifying and transmitting sound to the inner ear are contained within the housing 11. As shown in FIG. 3, these consist of a microphone 14, positioned at the inner end of a sound inlet passage 15 provided in one wall of the housing facing generally in a direction at right angles to the length of the projection 12; a transistorized amplifier circuit 16 connected between microphone 14 and an outlet receiver 17 and supplied by a miniature electrical dry cell battery 18 controlled by a volume control knob 19 rotatable mounted on the exterior wall of the housing. The battery is mounted in a slide carrier 20 which is removable received between the opposite walls of a cavity 21 in the housing having flexible electrical contacts 22 and 23 which permit removal and replacement of the battery 18. Components and circuits of the type described above are well known in the art and no claim is made to them per se.

The housing 11 is connected with one end of the projection 12 by means of a rotatable coupling, indicated generally by numeral 24. One such type of coupling may consist of a circular boss 25, attached to one wall of the housing, the outer end surface 26 being conically enlarged for snapping into engagement with a resilient O-ring 27 positioned in a seat 28 in a circular recess 29 provided in one end of the projection 12. The projection 12 is also provided with a central sound outlet passage 30 which communicates with recess 29 and a central passage 31 in the coupling which, in turn, communicates with the diaphragm of receiver 17 to transmit sound to the inner ear.

An important aspect of the invention lies in the fact that the housing is circular and the coupling 24 is positioned on the central axis of the housing, so that the housing may be rotated about its axis of symmetry in a generally vertical plane parallel with the side of the wearer's head. By placing the rotational axis near the axis of symmetry, the space occupied by the housing in the area of the concha surrounding and adjacent to the ear canal is distributed in such a way that the housing may be rotated throughout the entire arc of 360° without obstruction from the tapering rear wall of the concha.

In use, the wearer merely rotates the housing 11 until the passage 15 faces in the direction which produces the most satisfactory results under the given circumstances. The precise direction selected may vary from time to time and in accordance with the sourroundings.

The modified form of the invention shown in FIGS. 4 and 5 is designed for use where the user requires a soft resilient ear plug 32 molded to conform to the shape of the ear canal and having an internal passage 33 which carries the sound directly to the inner ear. Ear plugs of this type are usually employed in conjunction with a self-contained hearing aid having an elongated housing 34 provided at one end with a hollow supporting projection 35, one end of which is removably insertable into an opening which is molded into the ear plug at the outer end of passage 33. The projection 35 is usually rectangular in outer cross-section and in the prior art the ear plug included a fixed socket at the outer end of passage 33 designed to accomodate the particular type of hearing aid to be supported by the plug.

In the present case, the outer end of the passage 33 includes an enlarged socket 37 having a side wall whose surface is generally spherical in order to receive therein a generally ball-shaped coupling member 38. Since the plug 32 is generally made of resilient material the coupling member can be made of a rigid plastic material which can be snapped into place in the socket in frictional engagement. The coupling member is provided with an internal passage 39 which is shaped to frictionally retain the projection 35 of whatever type of hearing aid is to be used.

By means of this arrangement, not only is it possible to rotate the entire hearing aid and thus direct the fixed sound inlet passage, over the entire arc of 360° in a generally vertical plane, but it is also possible to vary the direction of the sound passage from side to side to a limited degree.

Therefore, by means of this invention it is possible for the owner of a conventional ear supported hearing aid to obtain the benefit received from being able to adjust the direction of the sound inlet passage. By supporting the housing outwardly from the ear canal by a sufficient distance, the housing can be rotated without coming in contact with the wall of the concha.

Another form of the invention is shown in FIGS. 6 and 7, wherein the hearing aid housing 40 is supported in the ear canal by a projecting sound outlet passage 41. Within the housing the microphone diaphragm 42 faces to the outside and receives sound through a passage which includes a bore 43 provided in the disc-shaped 44 which a spherical peripheral surface 45 received in a spherical socket 46 in the housing. The sound inlet passage also includes the shield 47 formed over the outer end of bore 43 which effectively serves to diminish the receipt of sounds except those coming from the direction of the open end of the shield and generally at right angles to the axis of the bore. Obviously, instead of the shield, which can be easily molded integrally with the member 44, a short L-shaped tube could be attached to the bore.

With this device, the housing itself may be designed to conform more closely to the contour of the ear, since the housing itself remains in fixed position at all times, while the member 44 may be rotated throughout the entire arc of 360° about the axis of the bore 43 and, in addition, may be tilted to some extent at an angle with respect to a plane normal to said axis to provide great flexibility for the user to choose the direction for the opening in the shield to face which gives the best results.

Figure 8:
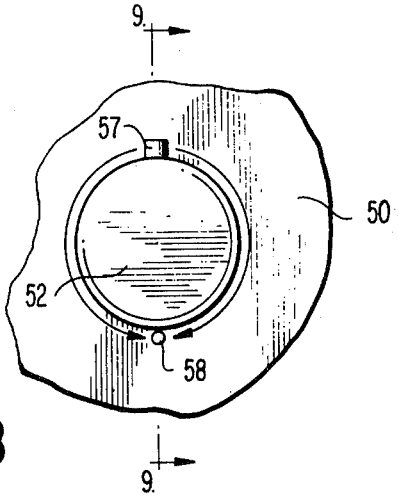
FIGS. 8 and 9 are partial side, and cross-sectional views of another modification.
Figure 9:
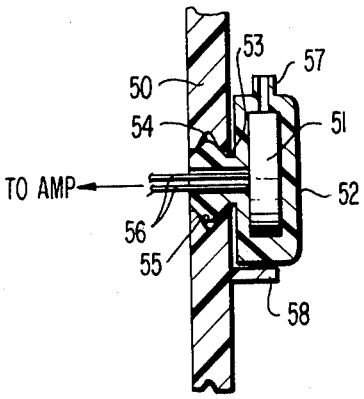

Still another form of the invention is shown in FIGS. 8 and 9, in which the numeral 50 indicates a portion of the vertical outer wall of the housing of an ear supported hearing aid. In this, as in the case of the previous embodiment, the shape of the housing may closely conform to that of the ear because it remains in fixed position.

The usual disc-shaped microphone, indicated by numeral 51, is contained within a small dome-shaped housing, or cap, 52. A short, hollow, stem 53 projects outwardly from the center of the base of the dome and extends through an opening in the housing wall 50 and the exterior of the stem is provided with a radial enlargement 54 which frictionally seats within a cooperating annular recess 55 in the opening. Connecting wires 56 lead from the microphone 51 to an amplifier (not shown). The sound inlet passage 57 projects outwardly from the periphery of the cap in a direction at right angles to the axis of rotation and sufficient space is provided between the microphone and the curved top wall of the cap to allow sounds picked up in passage 57 to reach the diaphragm. A stop member 58 is also formed on the wall 50 for contact by the passage 57, thereby permitting rotation of the cap substantially throughout a 360° arc but preventing continuous rotation for more than one turn in either direction to prevent damage to the wires 56.

We claim:

1. In a self-contained self-powered hearing aid of the type wherein a housing contains first transducer means for converting audible signals to electrical signals, second transducer means for converting electrical signals to audible signals, amplifier means including circuit means connecting said first and second transducer means, and battery means for energizing said transducer means and amplifier means, said housing including an outwardly projecting supporting member provided with an axial internal sound outlet passage in communication with the second transducer means, said first transducer means including a sound inlet passage means provided in said housing having an exterior opening facing predominantly in a direction generally at right angles to the axis of said outlet passage means, the improvement which includes means for supporting said housing exteriorly of the ear canal, pivot means connected with said housing for unrestricted adjustable positioning said exterior opening substantially in any direction lying in a vertical plane parallel to the side of the head of the wearer of the hearing aid.

2. The invention defined in claim 1, wherein said pivot means also includes means permitting limited adjustment of said inlet opening in directions transverse to said vertical plane.

3. The invention defined in claim 2, wherein said pivot means includes ball and socket coupling means.

4. The invention defined in claim 1, wherein the exterior of said housing is circular and said outwardly projecting member is removably received within the ear canal of a wearer and said pivot means connects said housing and said member at the axis of said housing, said inlet opening being formed in the wall of said housing.

5. The invention defined in claim 4, wherein said pivot means includes ball and socket coupling means.

6. The invention defined in claim 1, wherein said supporting member includes at least two elements, one of said elements projecting outwardly of said housing, the outer of said elements comprising a resilient molded ear plug to be removably received within the ear canal of a wearer, said ear plug also including socket means to removably receive said first member, said socket means being mounted in said second member for rotation about a horizontal axis.

7. The invention defined in claim 6, wherein said socket member is also movable to a limited extent in directions transverse to said horizontal axis.

8. The invention defined in claim 1, wherein said inlet opening is formed in an element separate from said housing, said element being supported on said housing by said pivot means for rotation about a horizontal axis.

9. The invention defined in claim 8, wherein said pivot means includes ball and socket coupling means for limited adjustment of said inlet opening in directions transverse to said axis of rotation.

10. The invention defined in claim 1, wherein housing includes a cap pivotally mounted on said housing for rotation about a horizontal axis and projecting outwardly therefrom on the side away from the ear canal of a wearer, said first transducer means including a microphone mounted in said cap, and said inlet opening being provided in said cap.

11. The invention defined in claim 10, wherein said cap includes stop means to prevent continuous rotation of said cap more than one complete turn.

12. Method of aiding the reception of audible signals by a human ear in conjunction with a self-powered, self-contained, electromechanical hearing aid provided with a directional microphone to detect audible signals, amplifier means and a receiver to transmit amplified audible signals into the inner ear canal, comprising the steps of:

a. attaching the directional microphone to an ear to support the microphone exteriorly of the ear canal for unrestricted adjustment of the direction of the microphone in a plane generally normal to the entrance to the ear canal, and;

b. adjusting the direction of said microphone in said plane by the wearer of the hearing aid while the hearing aid is so attached to select a position of the microphone which produces optimum reception of audible signals.

13. The method defined in claim 12, which includes the additional steps of supporting the microphone for additional limited movement transverse to said plane and adjusting the microphone to a limited degree in said transverse direction while so supported.

* * * * *